US007880408B2

(12) United States Patent
Calabretta et al.

(10) Patent No.: US 7,880,408 B2
(45) Date of Patent: Feb. 1, 2011

(54) METHOD FOR DESIGNING A RADIO-FREQUENCY CAVITY, IN PARTICULAR TO BE USED IN A CYCLOTRON, RADIO-FREQUENCY CAVITY REALISED USING SUCH A METHOD, AND CYCLOTRON USING SUCH A CAVITY

(75) Inventors: Luciano Calabretta, Frascati (IT); Mario Maggiore, Frascati (IT)

(73) Assignee: Istituto Nazionale Di Fisica Nucleare, Frascati (IT)

( * ) Notice: Subject to any disclaimer, the term of this patent is extended or adjusted under 35 U.S.C. 154(b) by 662 days.

(21) Appl. No.: 11/659,846

(22) PCT Filed: Aug. 3, 2005

(86) PCT No.: PCT/IT2005/000469

§ 371 (c)(1),
(2), (4) Date: Dec. 12, 2007

(87) PCT Pub. No.: WO2006/016387

PCT Pub. Date: Feb. 16, 2006

(65) Prior Publication Data

US 2008/0094011 A1 Apr. 24, 2008

(30) Foreign Application Priority Data

Aug. 11, 2004 (IT) ..... RM2004A0408

(51) Int. Cl.
*H05H 13/00* (2006.01)

(52) U.S. Cl. ..... 315/502; 315/500; 313/62

(58) Field of Classification Search ..... 315/500–507; 313/62

See application file for complete search history.

(56) References Cited

U.S. PATENT DOCUMENTS

2003/0146704 A1 8/2003 Ding et al.

FOREIGN PATENT DOCUMENTS

| | | |
|---|---|---|
| EP | 10-275700 | 10/1998 |
| WO | 00/19786 | 4/2000 |

OTHER PUBLICATIONS

PA McIntosh; "RF Cavity Computer Design Codes", Daresbury Laboratory, 1996 IEEE, pp. 2353-2355.

E. Tojyo, et al., "A Multi-Module Cavity Structure of Split Coaxial RFQ", Tokyo Institute for Nuclear Study-University of Tokyo, pp. 374-376, 2002.

*Primary Examiner*—Douglas W Owens
*Assistant Examiner*—Jianzi Chen
(74) *Attorney, Agent, or Firm*—Arent Fox LLP

(57) ABSTRACT

The invention relates to a method for designing a radio-frequency cavity, in particular to be used in a cyclotron, radio-frequency cavity (2) comprising a conductive enclosure or "liner" (3) connected by at least two essentially inductive elements or "stems" (4) to a capacitive electrode (2'), the method being characterized in that it comprises the following subsequent steps: A. subdividing the volume of said radio-frequency cavity (2) in a number of sub-cavities (10,20,30) corresponding to at least two stems (4), each sub-cavity comprising a respective (stem4); B. imposing a condition of magnetic orthonormality on the separation surfaces between said at least two sub-cavities (10,20,30); C. independently for each of said at least two sub-cavities (10,20,30), calculating the size and/or the position of the respective stem (4) with respect to the physical conditions at the boundaries. The invention further relates to a radio-frequency cavity realized using the method according to the invention, and a cyclotron using such a cavity.

29 Claims, 7 Drawing Sheets

METHOD FOR DESIGNING A RADIO-FREQUENCY CAVITY, IN PARTICULAR TO BE USED IN A CYCLOTRON, RADIO-FREQUENCY CAVITY REALISED USING SUCH A METHOD, AND CYCLOTRON USING SUCH A CAVITY

CROSS-REFERENCE TO RELATED APPLICATION

This application is a National Stage entry of International Application No. PCT/IT05/000469, filed Aug. 3, 2005, the entire specification claims and drawings of which are incorporated herewith by reference.

The invention concerns a method for designing a radio-frequency cavity, in particular to be used in a cyclotron, radio-frequency cavity realised using such a method, and cyclotron using such a cavity.

More particularly, the invention concerns a method for designing a radio-frequency cavity which comprises a capacitive electrode connected to at least two essentially inductive lines or "stems", the method enabling the use of two or more stems in order to be able to determine in a wide range the inductance of the radio-frequency cavity. The invention concerns also a radio-frequency cavity wherein between stems negligible currents flow, in particular designed using the above method and realised with the specifications obtained thereby. The invention further concerns a cyclotron wherein one or more cavities according to the invention are used.

In the following we will refer always, for expository simplicity, to the radio-frequency cavities of cyclotrons, it is however to be intended that the present invention applies to any radio-frequency cavity, i.e. cavities having a capacitance and an inductance. Moreover, when we will speak about cyclotrons, we will intend any type of cyclotrons, even if at any time will make clarifying reference to specific types.

In the cyclotrons, as it is known, both a magnetic field and an electric field act. The magnetic fields is responsible of the rotation, at fixed resonance frequency, of the particles one wishes to accelerate, whilst the electric field accelerates such particles.

The electrodes that produce the accelerating electrical field are integral part of a Radio Frequency (RF) circuit, comprising several radio-frequency cavities, through which the particles have to pass in order to be accelerated. Such radio-frequency cavities are dimensioned so that they resonate at a frequency equal to a harmonics of the above fixed resonance frequency.

Since the resonance frequency fr of a radio-frequency cavity depends on the values of inductance L and capacity C according to the relation fr=1/[2·p·(L·C)½], it is evident that, if high values of the resonance frequency are wished, the values of L and C must be small.

In the cyclotrons, as it is known, both a magnetic field and an electric field act. The magnetic fields is responsible of the rotation, at fixed resonance frequency, of the particles one wishes to accelerate, whilst the electric field accelerates such particles.

The electrodes that produce the accelerating electrical field are integral part of a Radio Frequency (RF) circuit, comprising several radio-frequency cavities, through which the particles have to pass in order to be accelerated. Such radio-frequency cavities are dimensioned so that they resonate at a frequency equal to a harmonics of the above fixed resonance frequency.

Since the resonance frequency $f_r$ of a radio-frequency cavity depends on the values of inductance L and capacity C according to the relation $f_r=1/[2\cdot\pi\cdot(L\cdot C)^{1/2}]$, it is evident that, if high values of the resonance frequency are wished, the values of L and C must be small.

In general, a radio-frequency cavity is designed trying to minimise the capacitance of the accelerating electrodes, which, having an extension, are actually "capacitive electrodes". By the way, a certain inductance has to be present in order to obtain the resonance and therefore one has to add inductive lines to the capacitive electrodes.

One does not succeed however in adding inductance which are as small as wished to the capacitive electrode.

The radio-frequency cavities are indeed usually provided of a part, said "stem", i.e. of a conductor connecting the electrode with the outer enclosure of the cavity, or "liner". In order to reduce the inductance of a stem, the dimensions of this orthogonal to flux lines of electric currents has to increase.

This, in turn, increases the capacity of the cavity because of the presence of the liner, which is an enclosure usually in copper, which defines the region of the space that is seat of the electromagnetic field produced by the cavity.

The stem can be considered, together with the liner, as a transmission line having inductance and capacitance values that add to those of the electrode itself, thus contributing to the overall inductance and capacity of the radio-frequency cavity.

During time, one has moved from resonant circuits realised with concentrated-parameters' models of capacity and inductance for low frequencies, to resonant cavities always more complex and at resonance frequencies always higher.

This has been possible thanks to the evolution of the calculating and simulation tools. However, for the cyclotron cavities one continues to use a substantially capacitive electrode connected to one or two stem.

Making reference to FIGS. 1 and 2, the compact cyclotrons (isochronous) of new generation, and in particular the superconductive cyclotrons, are characterised in that they have the magnetic pole constituted by an alternation of peaks 1 and valleys 2, i.e. regions where the distance between magnetic poles is very small and regions where the distance is large. In such a cases, it turns out to be natural to insert the accelerating capacitive electrodes 2' inside the valleys 2 exactly to reduce the capacitance associated to the same. A valley 2 and a peak 1 constitute together a so-called sector.

The particles to accelerate are introduced in the centre 101 of the cyclotron and go along a spiral trajectory in the cyclotron, being subject to electrical and magnetic field.

In general, if θ is the angular extension of the capacitive electrode, V the voltage applied on the capacitive electrode and h the acceleration harmonics, the energy gain per turn $E_g$, one obtains the following relation:

$$E_g=2\cdot V\cdot\sin(h\cdot\theta/2)$$

In other words, the largest energy gain per turn $E_g$ is obtained when $h\cdot\theta=180°$, and in such a case one has $E_g=2\cdot V$. In such conditions, the particle gains the largest possible energy both at the entrance and at the exit of the electrode.

If on the contrary the value of $h\cdot\theta\neq180°$, one has still acceleration but with smaller and smaller efficiency as one deviates form the optimal value of 180°.

Therefore, depending on the angular extension of the electrode of the radio-frequency cavity, the used frequencies are the $I^{st}$, $II^{nd}$, $III^{rd}$ harmonics, and in the case of some cyclotrons with four sectors and small size also the $IV^{th}$. In the case of a cyclotron with 4 sectors and with electrodes of angular extension≦45°, the optimum acceleration harmonics is the $IV^{th}$.

In the cyclotrons with radius of the upper magnetic pole larger than 80 cm, the capacitance of the accelerating electrodes is relatively high. Hence, realising a resonant cavity for frequencies larger than 70 MHz requires inductance values particularly small, with consequent decrease of the characteristic impedance $Z_o$ and therefore an increase of the current in the inductive areas. All this generates an increase of thermal leaks with consequent decrease of the quality coefficient Q of the cavity, defined as $$Q=2\cdot\pi\cdot f_{RF}\cdot E_i/E_d,$$

where $E_i$ is the energy stored in the cavity, $E_d$ is the energy dissipated in the same, and $f_{RF}$ is the characteristic frequency of the radio-frequency cavity.

Moreover, the decrease of the inductance is strongly influenced by the size of the stem, since the greater is the diameter of the last, the smaller is the cavity inductance value. Since the size of a stem is geometrically limited by the width of the electrode to which it is connected, the inductance value remains limited below. In such a way, therefore, the resonance frequency turns out to be limited above.

A solution for getting round this problem is the insertion of more stems in parallel in order to reduce the total inductance of the circuit.

There exist cyclotrons where there are two stem per electrode.

However, in many cases, for high resonance frequencies, with respect to high values of the capacitance of the electrode, it is not possible to obtain a solution of the problem with only two stems.

The application of three stems, never proposed to the Inventors' knowledge up to now, would allow a priori to obtain the desired resonance frequency without the above problems.

However, with more than two stems the optimisation of the cavity and of the voltage profile along the accelerating electrode cannot be realised with the existing methods.

The Applicant has indeed carried out a research finalised to the optimisation of the above cavity and voltage profile along the capacitive electrode that is provided of at least three stems.

From the results of the research, it has come out that the traditional optimisation methods do not lead to any satisfactory result. Indeed, trying to find size and positions of the stems with subsequent approximations, one is confronted to the practical impossibility of correlating for example different positions with the resulting voltage profiles. The configurations that can be obtained with traditional methods are not stable.

It is therefore not possible to arrive to a traditional optimisation for a wide range of resonance frequencies, and in particular with an electrode's capacitance larger than 80-100 pF and resonance frequencies of the radio-frequency cavity larger than 70-90 MHz.

It is an object of the invention to provide a method for designing a radio-frequency cavity, in particular to be used in a cyclotron, which solves the above drawbacks and problems.

It is also an object of the present invention to provide the apparatuses and tools required for performing the method object of the invention.

Further object of the invention is to provide a radio-frequency cavity, which presents inductance values which are not obtainable in the traditional radio-frequency cavities, in particular a radio-frequency cavity obtained using the method object of the invention.

Again, it is a specific object of the invention to provide a cyclotron utilising one or more radio-frequency cavities, which are object of the invention.

It is subject matter of the present invention a method for designing a radio-frequency cavity, in particular to be used in a cyclotron, the radio-frequency cavity comprising a conductive enclosure or "liner" connected by at least two essentially inductive elements or "stems" to a capacitive electrode, the method being characterised in that it comprises the following subsequent steps:

A. sub-dividing the volume of said radio-frequency cavity in a number of sub-cavities corresponding to at least two stems, each sub-cavity comprising a respective stem;

B. imposing a condition of magnetic orthonormality on the separation surfaces between said at least two sub-cavities;

C. independently for each of said at least two sub-cavities, calculating the size and/or the position of the respective stem with respect to the physical conditions at the boundaries.

Preferably according to the invention, the stems are at least three.

Preferably according to the invention, step C is effectuated by maximising the quality factor $Q=2\cdot\pi\cdot f_{RF}\cdot E_i/E_d$, $E_i$ being the energy stored in the radio-frequency cavity, $E_d$ being the energy dissipated in the same, and $f_{RF}$ being the characteristic frequency of the radio-frequency cavity.

Preferably according to the invention, Q is larger than 7000.

Preferably according to the invention, step C is realised in such a way to obtain a predetermined voltage distribution in each of said at least two sub-cavities.

Preferably according to the invention, said liner presents a lower base and an upper base, said at least two sub-cavities being obtained by sub-dividing said volume of the radio-frequency cavity by means of surfaces which extend from said lower base to said upper base.

Preferably according to the invention, said surfaces are perpendicular to a curve or to a development surface of the capacitive electrode.

Preferably according to the invention, the method further comprises the following step, subsequent to step C:

D. independently for each of said sub-cavities, varying the size of the sub-cavities and repeating the steps B and C, until a predetermined voltage distribution in the sub-cavities has been achieved.

Preferably according to the invention, during step A the capacitive electrode is sub-divided in such a way that the capacitance of at least one of said at least two sub-cavities is different from the capacitance of the others.

Preferably according to the invention, said at least one of said at least two sub-cavities is a central sub-cavity of the capacitive electrode.

Preferably according to the invention, during step A the capacitive electrode is sub-divided in portions of equal surface.

Preferably according to the invention, the method further comprises the following step, subsequent to step C:

E. increasing the number of said at least two stems and repeating steps A, B, C, until the value of the coefficient Q for each of said at least two sub-cavities has been exceeded a predetermined threshold.

Preferably according to the invention, in step E the step D is repeated as well.

It is specific subject matter of the invention a computer program, characterised in that it comprises code means suited to execute, when running on a computer, the method according to the invention.

It is specific subject matter of the invention a memory medium, readable by a computer, storing a program, characterised in that the program is the computer program according to the invention.

It is further specific subject matter of the invention a radio-frequency cavity, in particular to be used in a cyclotron, the radio-frequency cavity comprising a conductive enclosure or "liner" connected by at least two inductive elements or "stems" to a capacitive electrode, the radio-frequency cavity being characterised in that it is designed utilising the method according to the invention.

Preferably according to the invention, when the cavity is in operation, the ratio between the value of the totality of the current flowing from one of said at least two stems to another and the value of the current flowing inside one of said at least two stems is lower than 0.6.

Preferably according to the invention, said ratio is lower than 0.3.

Preferably according to the invention, said ratio is lower than 0.15.

Preferably according to the invention, the radio-frequency cavity comprises at least three stems.

Preferably according to the invention, the surface of the capacitive electrode is larger than 2 $m^2$.

Preferably according to the invention, the capacitive electrode presents a capacitance that is larger than 80 pF.

Preferably according to the invention, the capacitive electrode presents a capacitance that is larger than 100 pF.

Preferably according to the invention, the capacitive electrode is flat.

Preferably according to the invention, the radio-frequency cavity has a curved form originating from a point and opening over a determined angular extension $\theta$.

Preferably according to the invention, said angular extension is lower than or equal to 45°.

It is further specific subject-matter of the invention, a cyclotron, comprising one or more radio-frequency cavities, characterised in that said one or more radio-frequency cavities are radio-frequency cavities according to the invention.

Preferably according to the invention, the cyclotron has a resonance frequency equal to or larger than 70 MHz.

Preferably according to the invention, the cyclotron has a resonance frequency equal to or lower than 140 MHz.

Preferably according to the invention, the cyclotron comprises at least two radio-frequency cavities.

The invention will be now described, by way of illustration and not by way of limitation, by particularly referring to the drawings of the enclosed Figures, in which.

In the following of the description, equal reference signs will be used for indicating equal elements in the figures.

Figure 1:
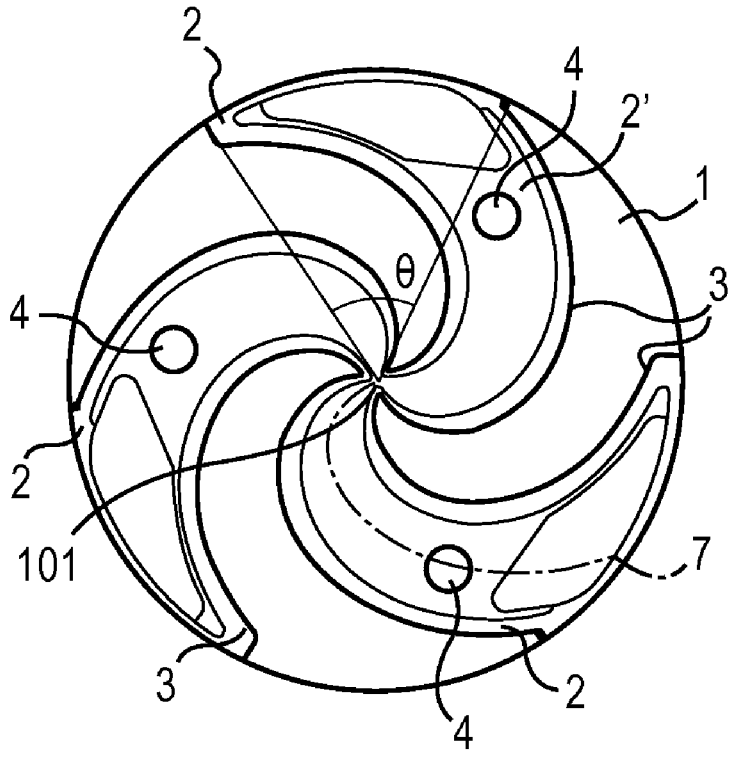
Fig. 1 PRIOR ART
FIG. 1 shows a view from above of the cavities of a cyclotron according to prior art.
Figure 2:
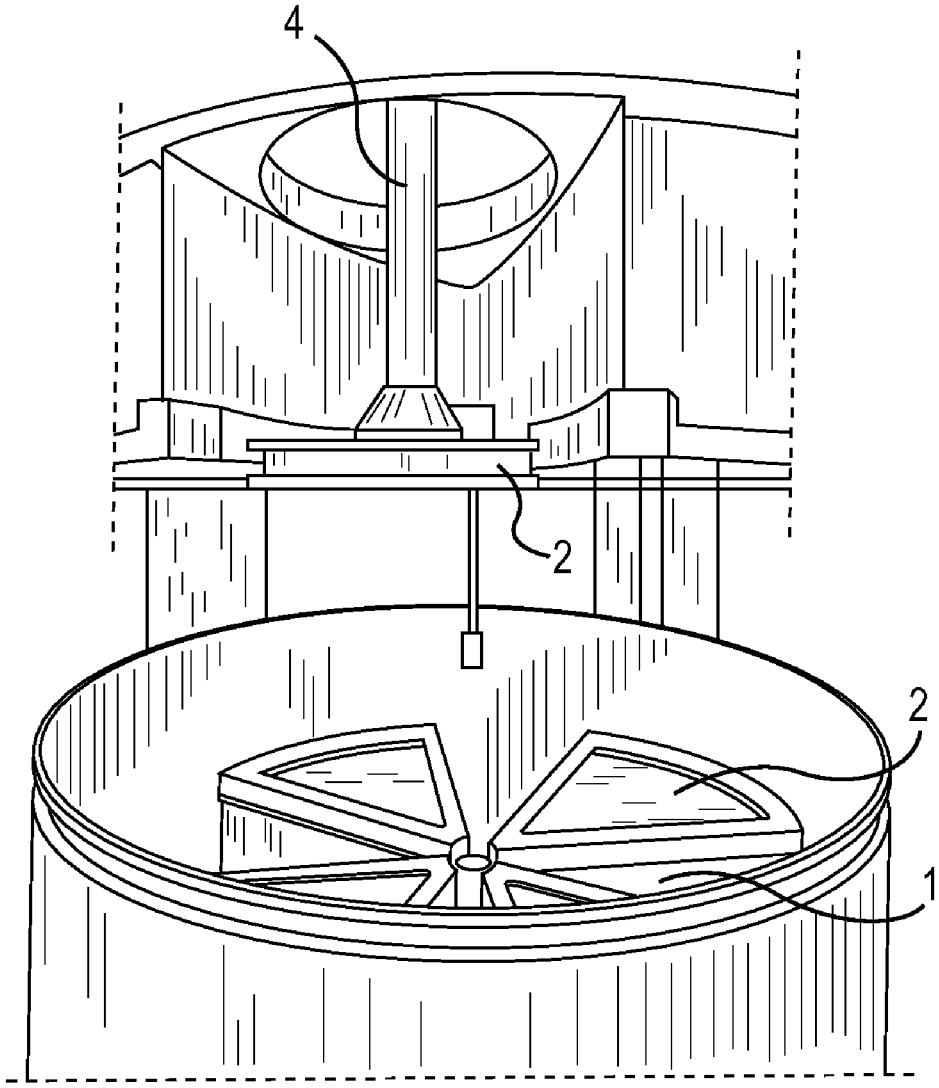
Fig. 2 PRIOR ART
FIG. 2 shows a perspective view of the interior of a cyclotron according to prior art, wherein the upper pole has been moved away from the lower pole.

Making reference to FIGS. 1 and 2, a cyclotron 100 (superconductive) according to prior art is internally constituted by a magnetic pole comprising peaks 1 and valleys 2. The valleys 2 are covered by the so-called "liners" 3. The liner is a surface typically in copper which constitutes the external surface of the RF cavity. In the valleys 2, inside the liner 3, are placed capacitive electrodes 2'. Such capacitive electrodes 2' comprise each a vertical stem 4 (typically in form of a right cylinder), which connect the electrodes to the liner.

The volume of the radio-frequency cavity is that defined by the liner 3, comprising the capacitive electrode 2'.

According to the method of the invention, it is possible to provide the capacitive electrodes 2' with three or more stems 4 in order to achieve the desired value of total inductance of the radio-frequency cavity 2, determining at the same time the size and the position of the same stems 4.

The stems have also their own value of capacitance, however it turns out to be negligible with respect to the value of capacitance of the capacitive electrode 2'.

In the following, we will always make reference to three stems 4 per radio-frequency cavity, that is per capacitive electrode 2', it is however to be understood that the method according to the invention applies to any number of stems 4, included the only two stems of the prior art.

Figure 3:
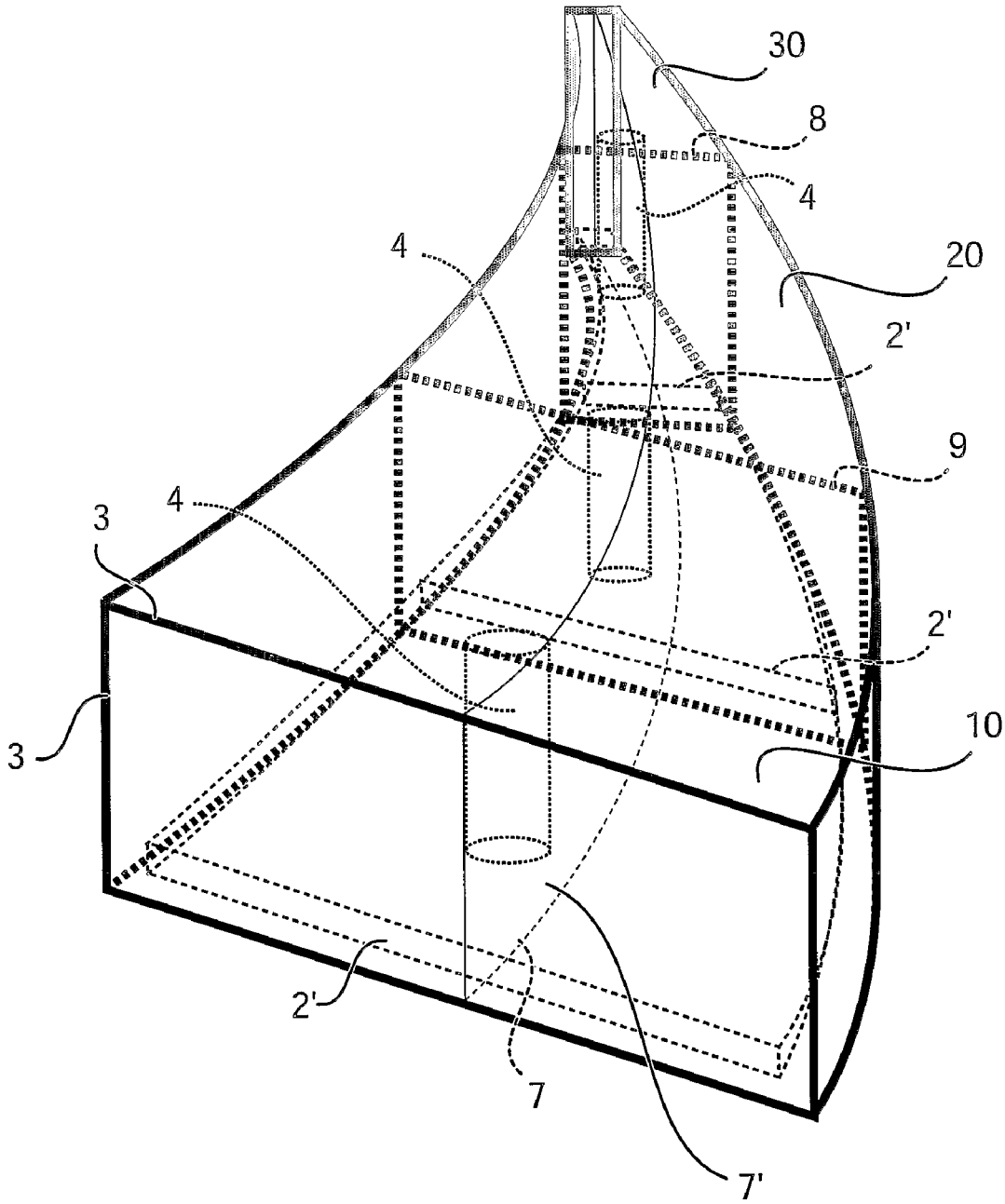
FIG. 3 shows a perspective view of a radio-frequency cavity according to the invention.

Making reference to FIG. 3, according to the method of the invention, it is needed first to subdivide the radio-frequency cavity 2 in three portions or sub-cavities 10, 20, 30 corresponding to the three stems (not shown).

In general, the subdivision can be effectuated in any manner. Concerning the radio-frequency cavity of a cyclotron, they develop in the direction of the capacitive electrode 2', which in his radial development follows a development line 7.

Advantageously, the sub-cavities 10, 20, 30 are obtained by cutting the volume of the cavity perpendicularly to a surface 7' corresponding to said development line 7.

One will obtain three different sub-cavities 10, 20, 30 having the corresponding part of the capacity of the electrode and the inductance of the corresponding stem.

Such three sub-cavities 10, 20, 30 are separated by two surfaces of separation 8 and 9.

As said above, the initial subdivision is arbitrary. In some applications, it is advantageous to divide the electrode in three sub-cavities 10, 20, 30 that are capacitively equal or comparable. In other applications, the sub-division is made in such a way that at least one of the sub-cavities 10, 20, 30 has a capacitance different from the others, preferably a central sub-cavity 20.

Before optimising every sub-cavity 10, 20, 30 independently from the others, on the interface surfaces between the sub-cavities 10, 20, 30 a condition of magnetic orthonormality is imposed.

Therefore, for each sub-cavity 10, 20, 30 the positions and/or sizes of the stems 4 optimising (i.e. maximising) the Q of each sub-cavity 10, 20, 30 are defined, taking into account the physical conditions at the boundaries (among which the maximum and minimum voltages, the distances of the capacitive electrodes 2' from the liner 3).

The modality of the subdivision of the radio-frequency cavity 2, and therefore the capacitive electrode 2', influences directly on the final distribution on the capacitive electrode 2'.

Indeed, in first approximation, if for example $C_1$ is the total capacitance of the sub-cavity 10 and $C_2$ the total capacitance of the sub-cavity 20, the average voltage on the portion of the capacitive electrode 2' corresponding to the sub-cavity 20 is $V_2=V_1\cdot(C_1/C_2)$.

As a consequence, by fixing a priori the final voltage distribution, the radio-frequency cavity can be divided in independent sub-cavities so that these have a capacitance that is inversely proportional to the required voltage.

Once independently optimised the single sub-cavities 10, 20, 30, the radio-frequency cavity 2 is constructed according to the obtained parameters.

The final result is the sum of the three or more cavities 10, 20, 30, whose voltages and currents join with each other smoothly.

Figure 4:
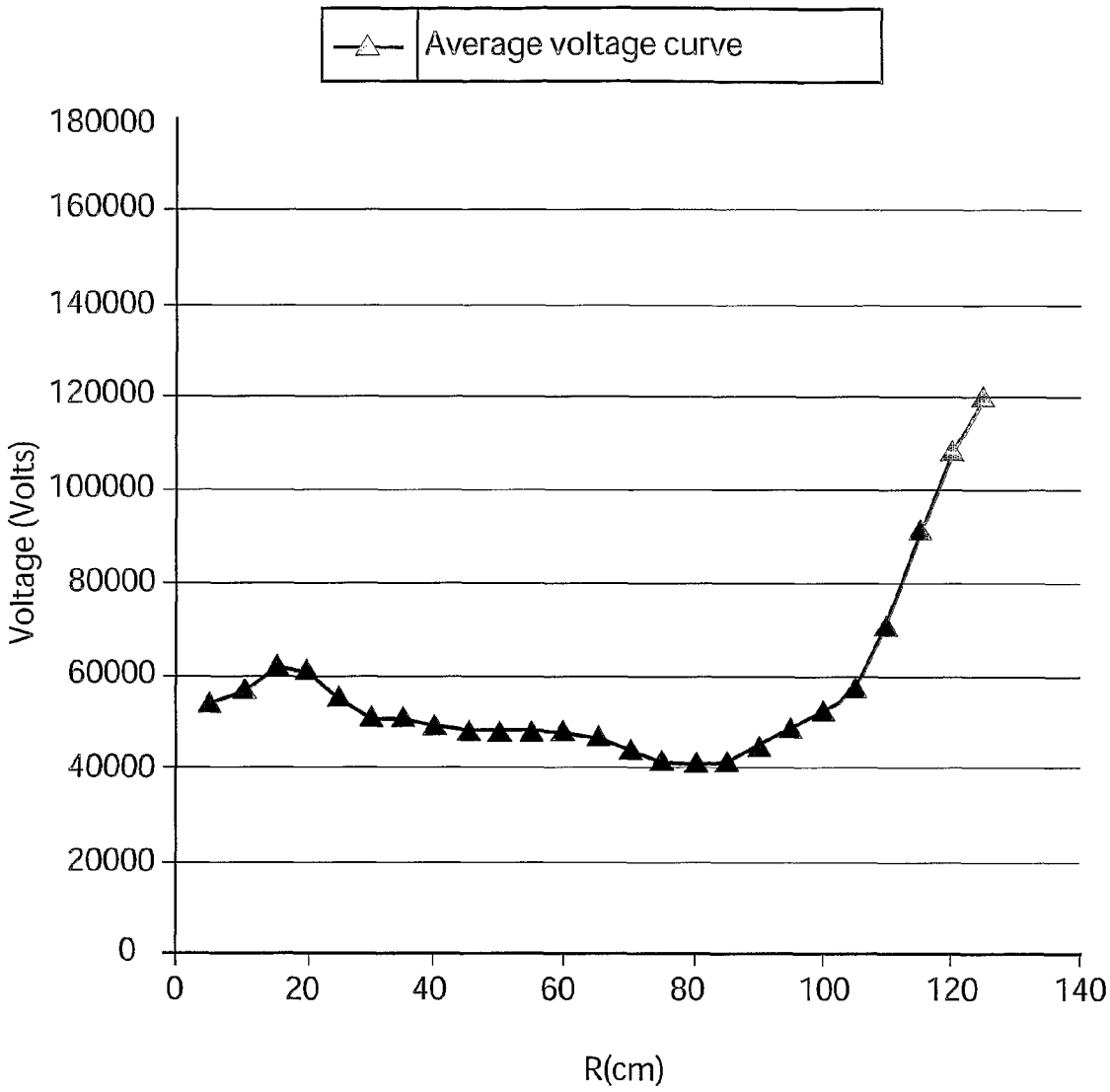
FIG. 4 shows an example of voltage curve along a capacitive electrode as a function of the radial distance in a cyclotron.
Figure 5:
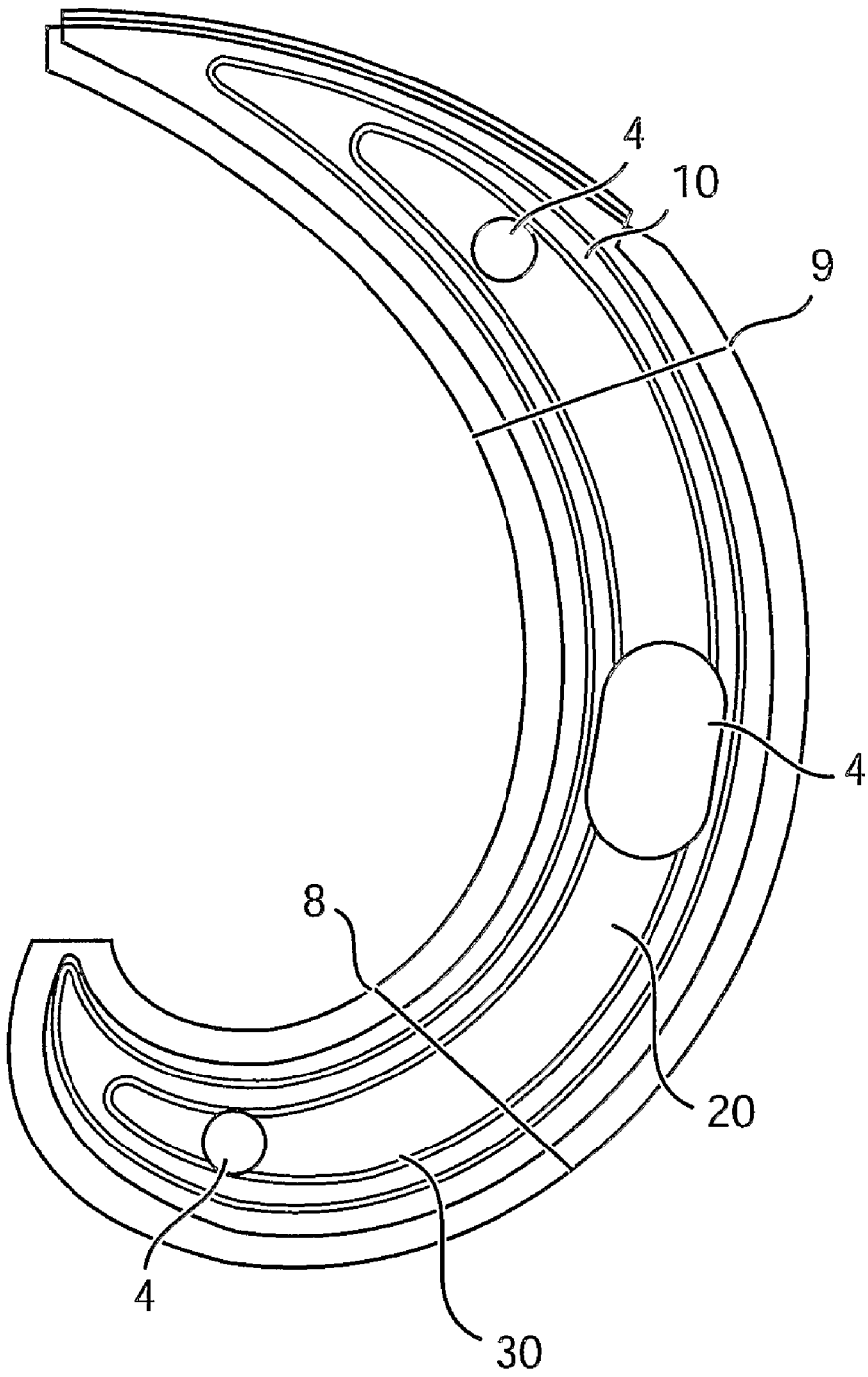
FIG. 5 shows a schematic view from above of a radio-frequency cavity according to the invention.

In FIG. 4 a voltage distribution on the capacitive electrode 2' of a radio-frequency cavity 2 is shown, which is useful for realising cyclotrons for medical applications, and in FIG. 5 it is shown a view from above of the geometry of a radio-frequency cavity 2 with three stems 4, optimised using the method according to the invention in order to obtain the voltage distribution of FIG. 4 on the capacitive electrode 2'.

Figure 6:
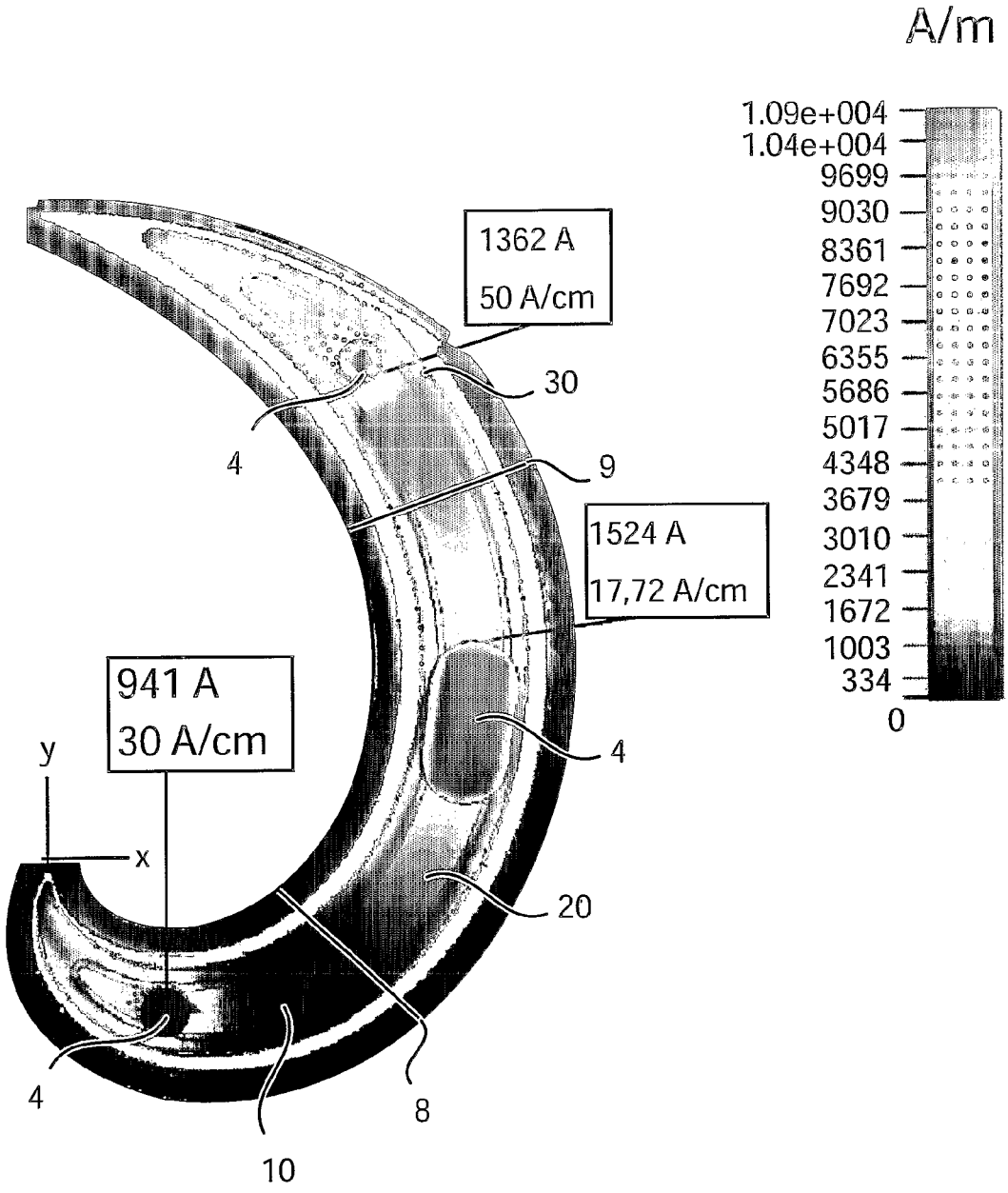
FIG. 6 shows a view from above of the current distribution in the radio-frequency cavity of FIG. 5, corresponding to the voltage distribution in the capacitive electrode illustrated in FIG. 4.

In FIG. 6 is illustrated the current distribution along the capacitive electrode 2'. As one can observe, there are darker areas between the stems; in such areas the flowing current is very small or almost null. This means that the currents cannot flow from a stem to another, but remains confined inside each sub-cavity comprising a stem 4.

Figure 7:
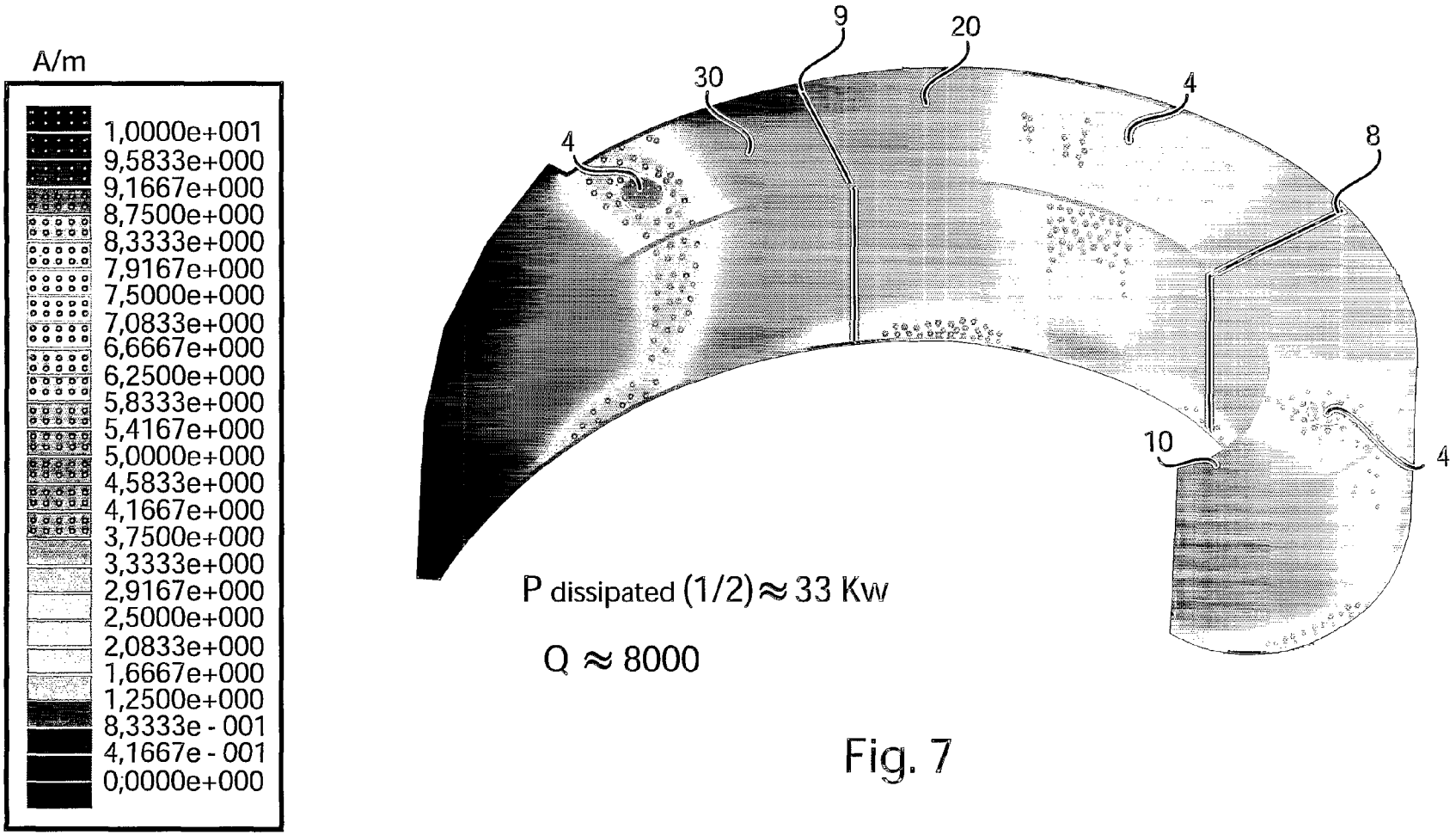
FIG. 7 shows a perspective view of the current distribution in the radio-frequency cavity of the FIGS. 5 and 6.

In FIG. 7 it is shown the current direction in the volume of the radio-frequency cavity 2 realised using the method of the invention.

One notes that in "recomposing" the sub-cavities 10, 20, 30 some currents appear in limited regions straddling the connection surfaces, such currents however turn out to be negligible, and do not influence the desired efficiency of the radio-frequency cavity 2. The total Q of the radio-frequency cavity does not turn out to be appreciably different from the single Q of the single sub-cavities 10, 20, 30.

It is also possible to re-iterate the method, starting from three stems 4, and increasing the number thereof until the convenient voltage distribution has been achieved.

The method according to the invention allows thus to obtain the desired course of the voltage and guarantees the optimum value of Q for the boundaries conditions fixed in advance.

The fact of being able to obtain a desired voltage profile is very important, since each capacitive electrode of radio-frequency cavity (for example in the different applications of a cyclotron) requires a different voltage profile.

An essential advantage of the method according to the invention consists in being able to optimise independently every sub-cavity of the radio-frequency cavity. By operating in this way, it is possible to obtain the desired courses of the voltages on the capacitive electrode and minimise the thermal leakage on the same.

An advantage of the method of the invention, correlated to the previous one, is that with the method one solves even the problems relating to the limiting of the voltage in the central region of the cyclotrons, where, because of the reduced spaces, the electrical fields can be exceedingly high.

The method according to the invention is extensible to any number of stems and is therefore useful for designing resonant cavities having large size and capacitances with respect to resonance frequencies to which one wished to operate.

The method according to the invention allows to design cyclotron cavities with characteristics not obtainable before. For example, it can be applied for designing a acceleration double-gap cavity for a ring cyclotron for protons from 1 GeV and beam power higher than 1 MW.

In particular, the method according to the invention allows to design e realise the resonant cavities for compact cyclotrons of high energy with frequency between 70 and 140 MHz, and with high values of Q, larger than 7000, even if the electrodes' surface is large (larger than 2 $m^2$) and the electrodes' capacitance is higher than 80-100 pF.

The preferred embodiments have been above described and some modifications of this invention have been suggested, but it should be understood that those skilled in the art can make variations and changes, without so departing from the related scope of protection, as defined by the following claims.

The invention claimed is:

1. A computer-implemented method for designing a radio-frequency cavity the radio-frequency cavity having a conductive liner connected by at least two inductive elements to a capacitive electrode, the computer comprising a processor and an accessible repository, the method comprising the following steps:

A. sub-dividing the volume of said radio-frequency cavity in a number of sub-cavities corresponding to at least two stems via the processor, each sub-cavity comprising a respective stem;

B. imposing a condition of magnetic orthonormality on separation surfaces between said at least two sub-cavities;

C. independently for each of said at least two sub-cavities, calculating at least one of size and position of the respective stem with respect to the physical conditions at the boundaries.

2. Method according to claim 1, characterised in that the stems are at least three.

3. Method according to claim 1, characterised in that step C is effectuated by maximising a quality factor $Q=2\cdot\pi\cdot f_{RF}\cdot E_i/E_d$, $E_i$ being an energy stored in the radio-frequency cavity, $E_d$ being an energy dissipated in the radio-frequency cavity, and $f_{RF}$ being a characteristic frequency of the radio-frequency cavity.

4. Method according to claim 3, characterised in that Q is larger than 7000.

5. Method according to claim 1, characterised in that step C is realised in such a way to obtain a predetermined voltage distribution in each of said at least two sub-cavities.

6. Method according to claim 1, characterised in that said liner comprises a lower base and an upper base, said at least two sub-cavities being obtained by sub-dividing said volume of the radio-frequency cavity by means of surfaces which extend from said lower base to said upper base.

7. Method according to claim 6, characterised in that said surfaces are perpendicular to one of a curve and a development surface of the capacitive electrode.

8. Method according to claim 1, further comprising the following step:

D. independently for each of said sub-cavities, varying the size of the sub-cavities and repeating the steps B and C, until a predetermined voltage distribution in the sub-cavities has been achieved.

9. Method according to claim 1, characterised in that during step A the capacitive electrode is sub-divided in such a way that a capacitance of at least one of said at least two sub-cavities is different from a capacitance of another of the at least two sub-cavities.

10. Method according to claim 9, characterised in that said at least one of said at least two sub-cavities is a central sub-cavity of the capacitive electrode.

11. Method according to claim 1, characterised in that during step A the capacitive electrode is sub-divided in portions of equal surface area.

12. Method according to claim 3, further comprising the following step:

E. increasing the number of said at least two stems and repeating steps A, B, C, until the quality factor Q for each of said at least two sub-cavities has exceeded a predetermined threshold.

13. Method according to claim 12, characterised in that, in step E, the step D is repeated.

14. Computer program comprising code means suited to execute, when running on a computer, the method according to claim 1.

15. Memory medium, readable by a computer, storing a program, characterised in that the program is the computer program according to claim 14.

16. Radio-frequency cavity comprising a conductive liner connected by at least three inductive elements to a capacitive electrode, the radio-frequency cavity being designed utilising the method according to claim 1.

17. Radio-frequency cavity according to claim 16, characterised in that, when in operation, a ratio between a totality of the current flowing from one of said at least three stems to another stem and a current flowing inside one of said at least three stems is lower than 0.6.

18. Radio-frequency cavity according to claim 17, characterised in that said ratio is lower than 0.3.

19. Radio-frequency cavity according to claim 18, characterised in that said ratio is lower than 0.15.

20. Radio-frequency cavity according to claim 16, characterised in that a surface area of the capacitive electrode is larger than 2 $m^2$.

21. Radio-frequency cavity according to claim 16, characterised in that the capacitive electrode has a capacitance that is larger than 80 pF.

22. Radio-frequency cavity according to claim 21, characterised in that the capacitive electrode has a capacitance that is larger than 100 pF.

23. Radio-frequency cavity according to claim 16, characterised in that the capacitive electrode is flat.

24. Radio-frequency cavity according to claim 23, wherein the cavity has a curved form originating from a point and opening over a determined angular extension $\theta$.

25. Radio-frequency cavity according to claim 24, characterised in that said angular extension is lower than or equal to 45°.

26. Cyclotron, comprising one or more radio-frequency cavities, characterised in that said one or more radio-frequency cavities are radio-frequency cavities according to claim 16.

27. Cyclotron according to claim 26, wherein the cyclotron has a resonance frequency equal to or larger than 70 MHz.

28. Cyclotron according to claim 27, wherein the cyclotron has a resonance frequency equal to or lower than 140 MHz.

29. Cyclotron according to claim 26, wherein the cyclotron comprises at least two radio-frequency cavities.

* * * * *